US009279231B2

(12) United States Patent
Bienfang et al.

(10) Patent No.: US 9,279,231 B2
(45) Date of Patent: Mar. 8, 2016

(54) REMOVABLE LINER ASSEMBLY FOR A DIPPER

(71) Applicant: Caterpillar Global Mining LLC, Oak Creek, WI (US)

(72) Inventors: David T. Bienfang, Racine, WI (US); Gregory A. Gruber, Muskego, WI (US)

(73) Assignee: Caterpillar Global Mining LLC, Oak Creek, WI (US)

( * ) Notice: Subject to any disclaimer, the term of this patent is extended or adjusted under 35 U.S.C. 154(b) by 384 days.

(21) Appl. No.: 13/866,326

(22) Filed: Apr. 19, 2013

(65) Prior Publication Data

US 2014/0314537 A1 Oct. 23, 2014

(51) Int. Cl.
*E02F 3/40* (2006.01)
*E02F 3/60* (2006.01)
*E02F 9/28* (2006.01)

(52) U.S. Cl.
CPC ... *E02F 3/40* (2013.01); *E02F 3/60* (2013.01); *E02F 9/2883* (2013.01)

(58) Field of Classification Search
CPC ..... E02F 3/40; E02F 3/60; E02F 9/28; E02F 9/2883; E21C 27/30
USPC ..... 37/444, 446, 451, 453; 172/719, 772; 414/694, 696, 697, 722
See application file for complete search history.

(56) References Cited

U.S. PATENT DOCUMENTS

| | | | | |
|---|---|---|---|---|
| 3,685,177 | A * | 8/1972 | Hahn et al. | 37/446 |
| 4,995,176 | A * | 2/1991 | Briscoe et al. | 37/454 |
| 5,063,695 | A * | 11/1991 | Briscoe et al. | 37/451 |
| 8,024,874 | B2 | 9/2011 | McClanahan et al. | |
| 8,336,233 | B1 | 12/2012 | Lombardo et al. | |
| 2007/0020079 | A1 | 1/2007 | Boyapally et al. | |
| 2009/0205227 | A1 | 8/2009 | Stewart et al. | |
| 2010/0005689 | A1 | 1/2010 | Leslie et al. | |
| 2011/0289803 | A1 | 12/2011 | Folkerts et al. | |
| 2013/0008062 | A1 | 1/2013 | Guimaraes et al. | |
| 2013/0078069 | A1 | 3/2013 | May | |

FOREIGN PATENT DOCUMENTS

| | | |
|---|---|---|
| CA | 2531473 | 6/2006 |
| CN | 202090377 | 12/2011 |
| KR | 2020100007187 | 7/2010 |
| WO | WO 2009/126045 | 10/2009 |
| WO | WO 2012/016251 | 2/2012 |

* cited by examiner

*Primary Examiner* — Ernesto Suarez
*Assistant Examiner* — Brendan Tighe

(57) ABSTRACT

A mining shovel includes a dipper having an inner surface, and a removable liner assembly coupled to the dipper and adjacent to the inner surface of the dipper. The removable liner assembly includes a first rail coupled to the dipper, a first liner segment disposed on the first rail and covering at least a portion of the first rail, and a second liner segment removably coupled to the first rail and covering at least one of a portion of the first liner segment and a portion of the first rail. The first rail is substantially covered by at least one of the first and second liner segments.

16 Claims, 4 Drawing Sheets

REMOVABLE LINER ASSEMBLY FOR A DIPPER

TECHNICAL FIELD

This disclosure relates to dippers or buckets for mining vehicles, and particularly to wear liners for such dippers and buckets.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Mining shovels or excavators use a dipper to scoop earth or other material. The dipper is typically subjected to abrasive materials and used under arduous conditions. For instance, the dipper may be used to dig, cut, and/or lift dirt, rock, concrete, metal, or other abrasive materials which wear against and abrade the surface of the dipper. When the surface of the dipper becomes sufficiently worn, the dipper must be replaced, which can be expensive and time-consuming.

Some excavating machines may include a wear assembly for protecting a digging edge. An example of such a wear assembly can be found in U.S. Pat. No. 8,024,874, issued Sep. 27, 2011, for "Wear Assembly for Excavating Machines," which discloses a wear assembly for protecting a digging edge of an excavating machine, "such as the lip of an excavating bucket." This wear assembly protects only the lip of the excavating bucket. Also, this wear assembly is welded to the excavating bucket and removable only by a significant amount of cutting and/or heating of the assembly.

SUMMARY

An embodiment of the present disclosure relates to a mining shovel. The mining shovel includes a dipper having an inner surface, and a removable liner assembly coupled to the dipper and adjacent to the inner surface of the dipper. The removable liner assembly includes a first rail coupled to the dipper, a first liner segment disposed on the first rail and covering at least a portion of the first rail, and a second liner segment removably coupled to the first rail and covering at least one of a portion of the first liner segment and a portion of the first rail. The first rail is substantially covered by at least one of the first and second liner segments.

Another embodiment of the present disclosure relates to a removable liner assembly for a dipper. The removable liner assembly includes a first rail configured to be coupled to the dipper, a first liner segment positionable on the first rail and configured to cover a portion of the first rail, and a second liner segment removably couplable to the first rail and configured to cover at least one of a portion of the first liner segment and a portion of the first rail. The first rail is substantially covered by at least one of the first and second liner segments.

Another embodiment of the present disclosure relates to A dipper for a mining shovel. The dipper includes an inner surface, and a removable liner assembly adjacent to the inner surface. The removable liner assembly includes a first rail coupled to the inner surface, a first liner segment disposed on the first rail and covering at least a portion of the first rail, and a second liner segment removably coupled to the first rail and covering at least one of a portion of the first liner segment and a portion of the first rail. The first rail is substantially covered by at least one of the first and second liner segments.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
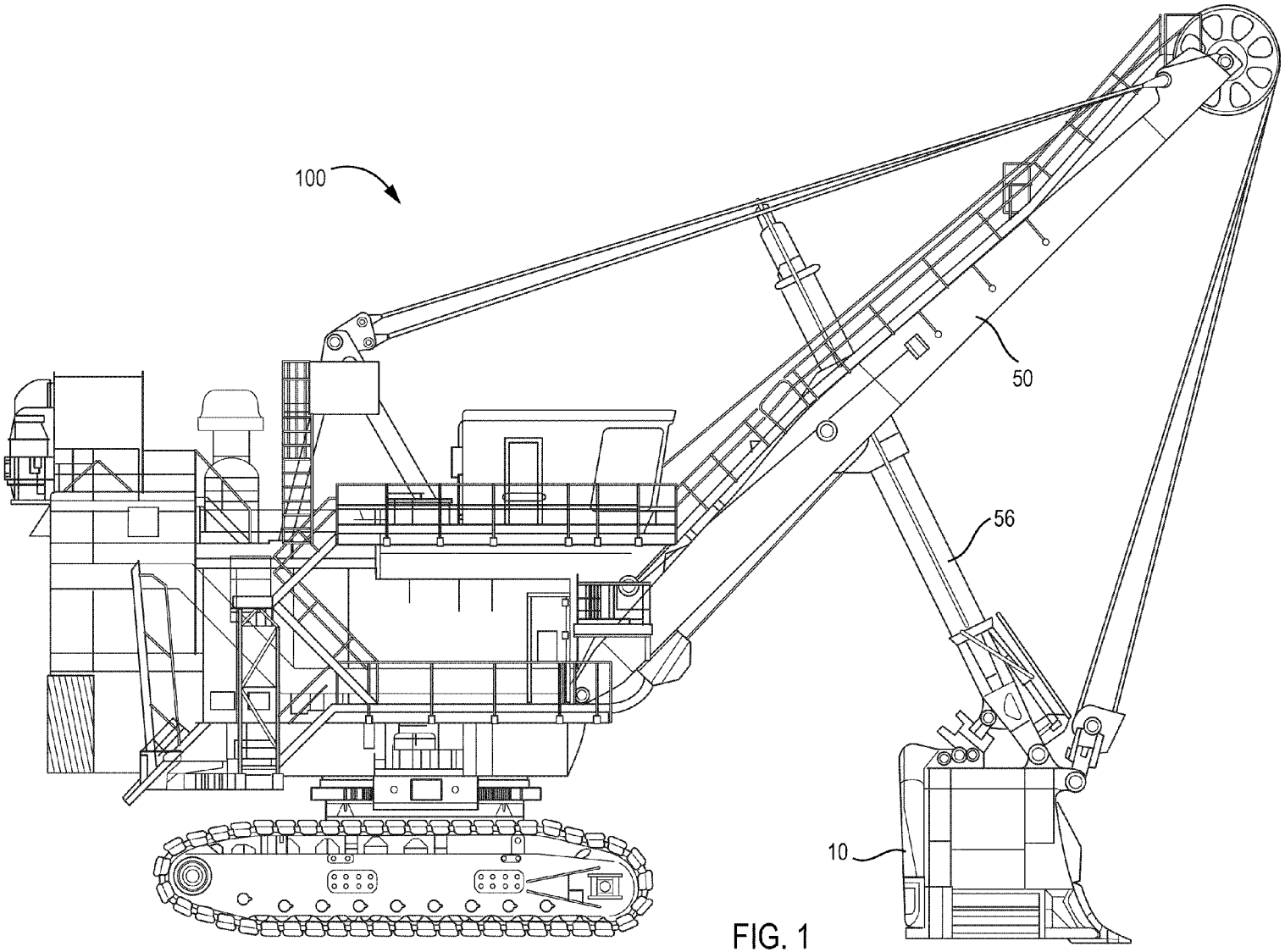
FIG. 1 is a side view of a mining shovel having a dipper, according to an exemplary embodiment.

Referring to FIG. 1, a mining shovel 100 is shown, according to an exemplary embodiment. The mining shovel 100 includes a dipper arm 56 and a dipper 10 (e.g., bucket, etc.) supported by a boom 50. The dipper 10 is coupled to the dipper arm 56, moving in more than one direction along with the dipper arm 56. The dipper 10 is configured to hold earth and other materials that are loaded into the dipper 10 by the action of the dipper arm 56. The dipper arm 56 is configured to apply a force to the dipper 10, pushing the dipper 10 into a surface (i.e. a bank of material such as overburden, ore, or other material to be mined or moved and referred to collectively as "mining material"). The dipper 10 is forced into the bank by the force of the dipper arm 56, digging into the bank and filling the dipper 10 with mining material (e.g. earth, fragmented rock, etc.).

Although the disclosure is shown and described by way of example with reference to a mining shovel 100, the disclosure is also applicable for use with any machine or vehicle that includes a dipper or bucket for digging and/or transporting material, such as excavators, etc., all of which are intended to be within the scope of this disclosure.

Figure 2:
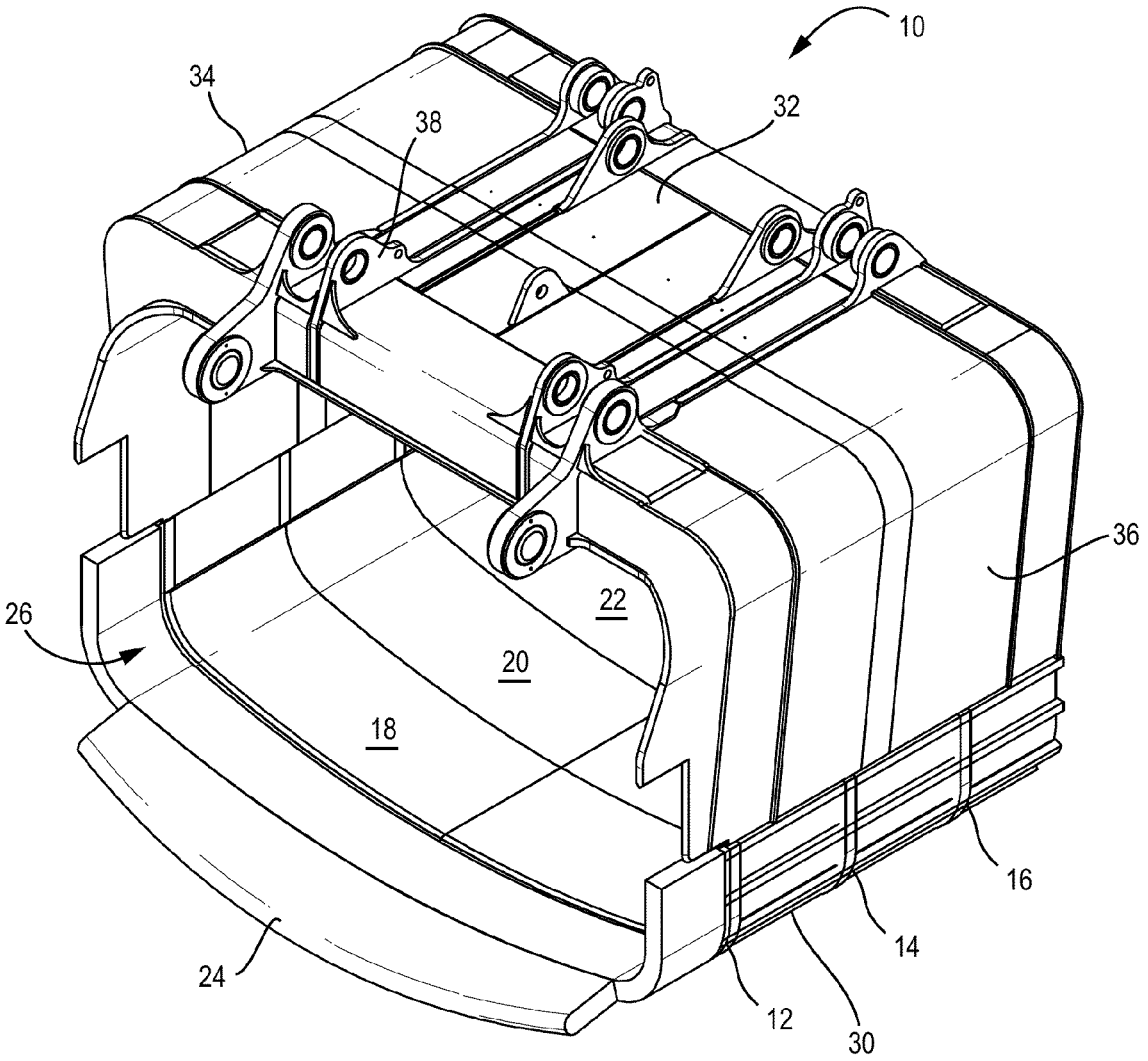
FIG. 2 is a perspective view of a dipper for a mining shovel, according to an exemplary embodiment.
Figure 3:
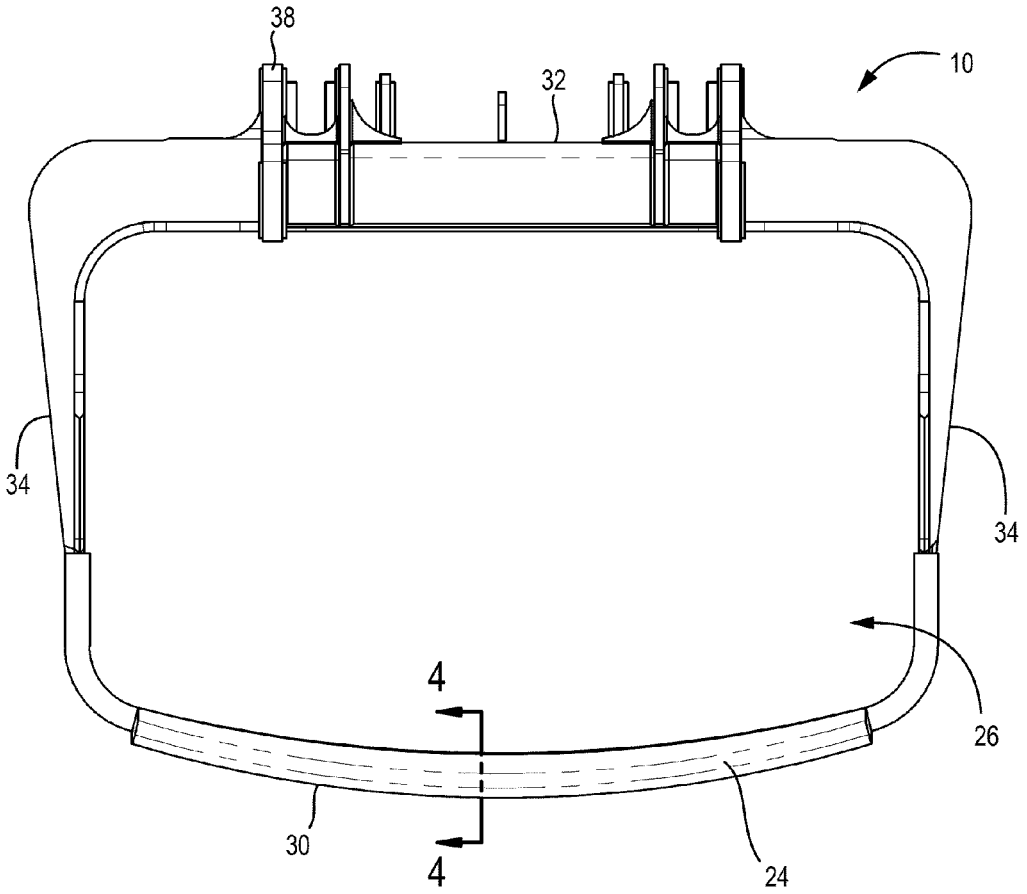
FIG. 3 is a front view of the dipper of FIG. 2.

Referring now to FIGS. 2 and 3, the dipper 10 is shown, according to an exemplary embodiment. The dipper 10 includes a front wall 30 coupled to a back wall 32 with side walls 34. The walls 30, 32, and 34 define an open forward end 26 of the dipper 10 through which the dipper 10 is filled. Teeth may be provided on a forward edge 24 of the front wall 30 to define a cutting edge that cuts into the ground to fill the dipper 10. The dipper back wall 32 includes mounting lugs 38 with which the dipper 10 is coupled to the dipper arm 56 extending from the shovel 100.

In an exemplary embodiment, the dipper 10 includes a removable liner assembly that covers an inner surface 40 (shown in FIG. 4) of the dipper 10. The removable liner assembly may protect the surface of the dipper 10 from wear associated with the digging operations of the mining shovel 100. For instance, as the dipper 10 is pushed into a mining surface, the dipper 10 is loaded with mining material that flows across a surface (e.g., inner surface 40) of the dipper 10. The mining material may include fragmented rock, sand, or other materials that may be abrasive and/or damaging to the dipper 10. The removable liner assembly provides a protective layer over the inner surface 40 of the dipper 10, protecting the inner surface 40 from wear caused by the mining material. When the removable liner assembly is substantially worn due to extended exposure to the mining material or for any other reason, the removable liner assembly may be removed and replaced, while the integrity of the dipper 10 and the inner surface 40 is maintained.

The removable liner assembly includes removable segments (e.g., liner segments, covers, strips, bands, etc.) shown as segments 18, 20, and 22 arranged in a generally edge-to-edge manner to form a single layer, removable protective liner. In the illustrated embodiments of the FIGURES, the removable liner assembly is shown to include three segments 18, 20, and 22, but the removable liner assembly may include another number of removable segments depending on the size of the dipper 10 or the particular application for which the dipper 10 is used. The removable liner assembly may also be configured to include any number of layers as is suitable. The segments 18, 20, and 22 cover the inner surface 40 of the dipper 10, and are intended to protect the inner surface 40 of the dipper 10 from wear caused by frequent digging. In one embodiment, the segments 18, 20, and 22 are sized and shaped to fit over the inner surface 40 of the dipper 10 such that the inner surface 40 of the dipper 10 is substantially completely covered. In one embodiment, the inner surface 40 includes the entire inner face of the dipper 10, and the segments 18, 20, and 22 may extend up the sides and around the inner perimeter of the dipper 10, substantially covering the inner surface 40. In another embodiment, the segments 18, 20, and 22 of the removable liner assembly may cover only the highest wear areas of the inner surface 40. In an exemplary embodiment, the segments 18, 20, and 22 are made from a material that is relatively resistant to wear so that the segments 18, 20, and 22 do not require frequent replacement. However, the segments 18, 20, and 22 are removable in exemplary embodiments so that the segments 18, 20, and 22 may be replaced as necessary (e.g., when one of the segments 18, 20, or 22 has worn such that the segment 18, 20, or 22 no longer effectively protects the inner surface 40 of the dipper 10, etc.).

In the illustrated embodiment of FIG. 2, the segments 18, 20, and 22 are releasably coupled to the dipper 10 and to each other in an interlocking manner by rails (e.g., bars, ribs, tracks, etc.) 12, 14, and 16. The three rails 12, 14, and 16 are connected to the inner surface 40 of the dipper 10, providing support for the segments 18, 20, and 22. The rails 12, 14, and 16 may be welded to the dipper 10, connected to the dipper 10 by a locking assembly (e.g., a fastener, a nut and bolt, etc.), or coupled to the dipper 10 in another manner suitable for the particular application. The rails 12, 14, and 16 are shown as being positioned substantially parallel to each other, running along the width of the front wall 30 and extending at least along a distance from the side wall 34 to the side wall 36. However, in other embodiments the rails 12, 14, and 16 may be in another configuration suitable for coupling the segments 18, 20, and 22 to the inner surface 40 of the dipper 10. The removable liner assembly may also include a greater or lesser number of rails in other embodiments, as is suitable for the particular application.

Figure 4:
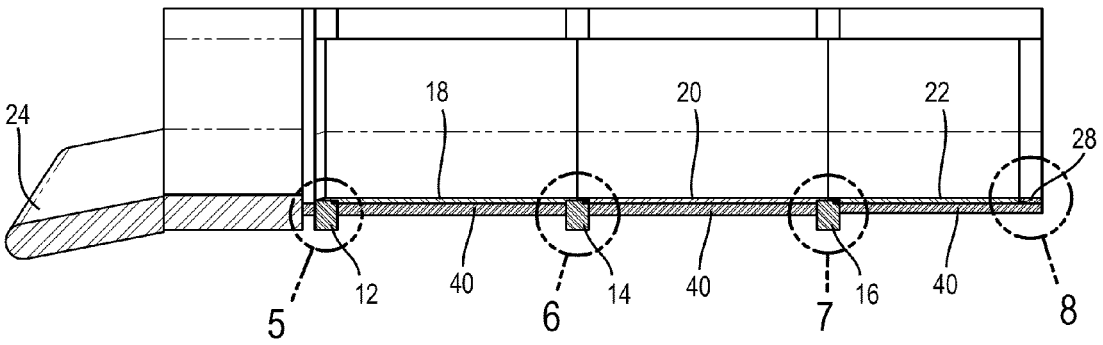
FIG. 4 is a cross-section view of the dipper of FIG. 3 in the 4-4 direction, according to an exemplary embodiment.
Figure 5:
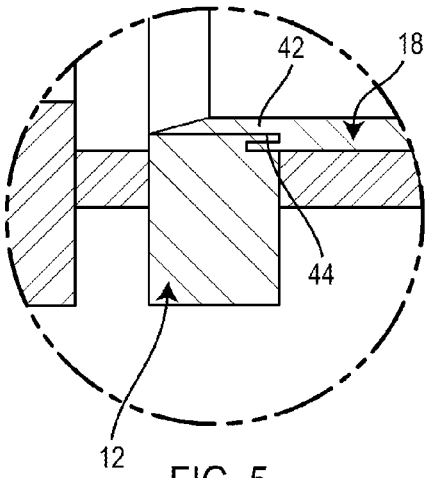
FIG. 5 is a detail view of a first liner row for the dipper connected to a rail, according to an exemplary embodiment.
Figure 6:
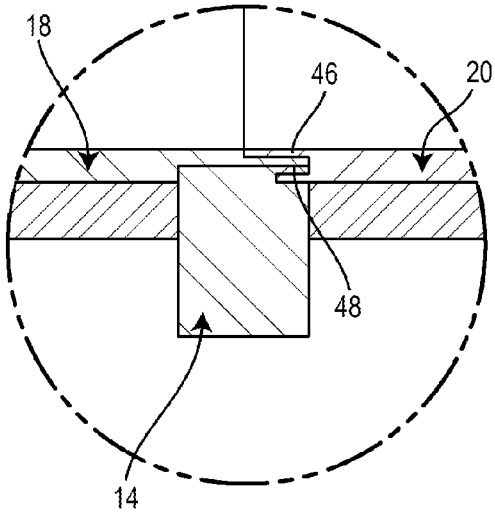
FIG. 6 is a detail view of a second liner row for the dipper connected to a second rail, according to an exemplary embodiment.

Referring to FIGS. 4-6, rail 12 is shown coupled to the dipper 10 at a position adjacent to the forward edge 24 of the front wall 30, according to an exemplary embodiment. The rail 12 is configured to receive the first segment 18, mating with the first segment 18 such that the first segment 18 covers a portion or substantially all of the rail 12 to protect the rail 12. Rail 14 is coupled to the dipper 10 at a position substantially parallel to the rail 12 and a distance further rearward from the forward edge 24 than the rail 12. The first segment 18 rests on the rail 14, covering a portion or substantially all of the rail 14 to protect the rail 14. The rail 14 is also configured to receive the second segment 20, mating with the second segment 20 such that the second segment 20 interlocks with the rail 14 and covers a trailing end of first segment 18 in a close-fitting arrangement to minimize entry of foreign material. The first segment 18 and second segment 20 thus substantially completely cover the rail 14, providing a removable barrier and protecting the rail 14 from wear caused by mining materials collected in, transported, and discharged from the dipper 10.

Figure 7:
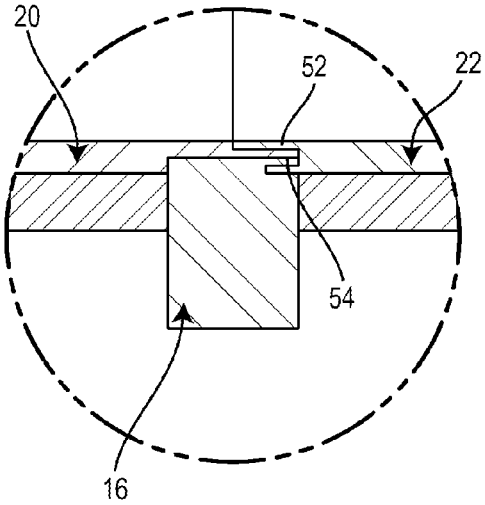
FIG. 7 is a detail view of a third liner row for the dipper connected to a third rail, according to an exemplary embodiment.

Referring to FIGS. 4 and 7, rail 16 is coupled to the dipper 10 at a position substantially parallel to rails 12 and 14 and at a distance further rearward from the forward edge 24 than rails 12 and 14. The second segment 20 interlocks with the rail 16, covering a portion or substantially all of the rail 16 to protect the rail 16. The rail 16 is also configured to receive the third segment 22, mating with the third segment 22 such that the third segment 22 interlocks with the rail 16 and covers a trailing end of second segment 20 in a close-fitting arrangement to minimize entry of foreign material. The second segment 20 and third segment 22 thus substantially completely cover the rail 16, providing a removable barrier and protecting the rail 16 from wear caused by mining materials collected in, transported, and discharged from the dipper 10. The configuration of the rails 12, 14, and 16 and the segments 18, 20, and 22 is shown in further detail in FIGS. 4-8.

Referring further to FIG. 4, a cross-section of the dipper 10 is shown, according to an exemplary embodiment. In this embodiment, the inner surface 40 is shown covered by the layer of interlocking removable segments 18, 20, and 22. The removable segments 18, 20, and 22 are supported and retained by the rails 12, 14, and 16 and the inner surface 40, forming a substantially continuous protective layer for the dipper 10. The removable segments 18, 20, and 22 are intended to provide a rugged, durable protective liner capable of withstanding forces resulting from use (e.g., digging, etc.) of the dipper 10, protecting the rails 12, 14, and 16 and the inner surface 40 from damage caused by repeated use of the dipper 10. The segments 18, 20, and 22 are configured to mate with each other, with each segment 18, 20, and 22 having a mating structure such as hooks or connecting portions for mating with another adjacent segment 18, 20, or 22. Thus, in exemplary embodiments the segments 18, 20, and 22 are fitted within the dipper 10 (as in FIG. 4) without the use of a more permanent locking assembly (e.g., fasteners, welds, etc.). The segments 18, 20, and 22 interlock with the rails 12, 14, and 16, and with each other to removably lock into place within the dipper 10 and over the inner surface 40 and the rails 12, 14, and 16 such that the segments 18, 20, and 22 may be removed without the use of a cutting or heating device. In an exemplary embodiment, the segments 18, 20, and 22 may be removed and replaced within the dipper 10 without removing the dipper 10 from the mining shovel 100.

Referring further to FIG. 5, the first segment 18 is shown removably coupled to the rail 12, according to an exemplary embodiment. In this embodiment, the first segment 18 includes a generally U-shaped groove 42 (e.g., notch, indent, etc.) that is sized and shaped to mate with an opening 44 of the rail 12 (e.g., in a tongue-and-groove manner or the like). The U-shaped groove 42 and the opening 44 fit together such that a portion of the first segment 18 interlocks with the rail 12, covering a portion or substantially all of the rail 12 and protecting the rail 12 from material flowing across the first segment 18 while the dipper 10 is in use.

Referring further to FIG. 6, the first segment 18 and the second segment 20 are shown removably coupled to the rail 14, according to an exemplary embodiment. In this embodiment, the second segment 20 includes a generally U-shaped groove 46 that is sized and shaped to mate with the first segment 18 and an opening 48 of the rail 14. The U-shaped groove 46, the first segment 18, and the opening 48 of the rail 14 interlock such that the second segment 20 covers a portion or substantially all of the first segment 18. The first segment 18 and second segment 20 each cover a portion or substantially all of the rail 14, substantially completely covering the rail 14 and protecting the rail 14 from material flowing across the segments 18 and 20 while the dipper 10 is engaged in a digging operation or otherwise in use.

Referring again to FIGS. 5 and 6, the first segment 18 is removably coupled to the rails 12 and 14. In an exemplary embodiment, the rail 12 and the rail 14 are both substantially stationary relative to the dipper 10. The stationary rail 12 provides a stop (e.g., support, brace, etc.) for the first segment 18 and prevents movement of the first segment 18 in a first horizontal direction (i.e., to the left according to FIG. 5) relative to the dipper 10. The first segment 18 also mates with the rail 14 and the second segment 20 (see FIG. 6), with the stationary rail 14 providing a stop for the first segment 18 and preventing movement of the first segment 18 in a second horizontal direction (i.e., to the right according to FIG. 6) relative to the dipper 10. The second segment 20 covers a portion or substantially all of the first segment 18, interlocking with the first segment 18 to maintain the position of the first segment 18 between the two stationary rails 12 and 14. Thus, the first segment 18 may be removed from the dipper 10 by removing the second segment 20 and moving the first segment 18 away from the rail 12.

Referring now to FIG. 7, the second segment 20 and the third segment 22 are shown removably coupled to the rail 16, according to an exemplary embodiment. In this embodiment, the third segment 22 includes a generally U-shaped groove 52 that is sized and shaped to mate with the second segment 20 and an opening 54 of the rail 16. The U-shaped groove 52, the second segment 20, and the opening 54 of the rail 16 interlock such that the third segment 22 covers a portion or substantially all of the second segment 20. The second segment 20 and third segment 22 each cover a portion or substantially all of the rail 16, substantially completely covering the rail 16 and protecting the rail 16 from material flowing across the segments 20 and 22 while the dipper 10 is engaged in a digging operation or otherwise in use.

Referring again to FIGS. 6 and 7, the second segment 20 is removably coupled to the rails 14 and 16. The stationary rail 14 and the first segment 18 provide a stop for the second segment 20 and prevent movement of the second segment 20 in a first horizontal direction (i.e., to the left according to FIG. 6) relative to the dipper 10. The second segment 20 also mates with the rail 16 and the third segment 22 (see FIG. 7), with the stationary rail 16 providing a stop for the second segment 20 and preventing movement of the second segment 20 in a second horizontal direction (i.e., to the right according to FIG. 7) relative to the dipper 10. The third segment 22 covers a portion or substantially all of the second segment 20, interlocking with the second segment 20 to maintain the position of the second segment 20 between the two stationary rails 14 and 16. Thus, the second segment 20 may be removed from the dipper 10 by removing the third segment 22 and moving the second segment 20 away from the rail 14 and the first segment 18.

Figure 8:
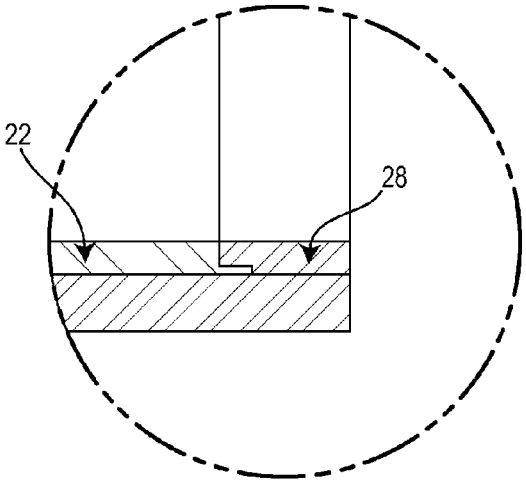
FIG. 8 is a detail view of the third liner row for the dipper connected to the back of the dipper, according to an exemplary embodiment.

Referring now to FIG. 8, the third segment 22 is shown removably coupled to a back rail 28, according to an exemplary embodiment. In this embodiment, the back rail 28 is sized and shaped to receive the third segment 22. The third segment 22 interlocks with the back rail 28, preventing the third segment 22 from moving in a first horizontal direction (i.e., to the right according to FIG. 8) relative to the dipper 10. In an exemplary embodiment, the back rail 28 includes a locking mechanism (not shown), such as a set of keys, for locking the third segment 22, and thus locking the removable liner assembly into the position shown in the FIGURES. The locking mechanism may be a bolt-on configuration, or may include a welded portion.

As described above, in an exemplary embodiment the third segment 22 interlocks with the second segment 20, and the second segment 20 interlocks with the first segment 18, such that the segments 18, 20, and 22 are substantially stationary within the dipper 10. The first segment 18 may be removed from its illustrated location within the dipper 10 only by removing the second segment 20, and the second segment 20 may be removed from its illustrated location within the dipper 10 only by removing the second segment 20 and the third segment 22. Thus, by locking the position of the third segment 22, the back rail 28 maintains the installed position of the removable liner assembly within the dipper 10 (i.e. the illustrated position of the FIGURES).

The construction and arrangements of the removable liner assembly, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

INDUSTRIAL APPLICABILITY

The disclosed removable liner assembly may be implemented into any machine having a dipper or bucket for excavating material. The disclosed removable liner assembly may help reduce downtime due to dipper replacement by protecting the dipper from wear associated with excavating material.

The disclosed removable liner assembly may protect one or more surfaces of the dipper so that the dipper does not require frequent replacement.

The disclosed removable liner assembly may also reduce downtime and/or cost associated with dipper wear and replacement by providing a removable liner assembly for protecting the dipper. The disclosed removable liner assembly includes a minimal amount of locking mechanisms, and may be removed in less time than a typical wear liner for protecting an excavating bucket.

It will be apparent to those skilled in the art that various modifications and variations can be made to the disclosed removable liner assembly. Other embodiments will be apparent to those skilled in the art from consideration of the specification and practice of the disclosed removable liner assembly. It is intended that the specification and examples be considered as exemplary only, with a true scope being indicated by the following claims and their equivalents.

What is claimed is:

1. A mining shovel, comprising:

a dipper having an inner surface; and a removable liner assembly coupled to the dipper and adjacent to the inner surface of the dipper, the removable liner assembly comprising:

a first rail coupled to the dipper;

a first liner segment disposed on the first rail and covering at least a portion of the first rail;

a second liner segment removably coupled to the first rail and covering at least one of a portion of the first liner segment and a portion of the first rail;

a second rail coupled to the dipper, wherein the second liner segment is disposed on the second rail and covering at least a portion of the second rail; and a third liner segment removably coupled to the second rail, the third liner segment covering at least one of a portion of the second liner segment and portion of the second rail;

wherein the first rail is substantially covered by at least one of the first and second liner segments, and wherein the second rail is substantially covered by at least one of the second and third liner segments.

2. The mining shovel of claim 1, wherein the first rail is substantially stationary relative to the dipper, providing a stop for the second liner segment and preventing movement of the second liner segment in a first horizontal direction relative to the dipper.

3. The mining shovel of claim 1, wherein the second rail is substantially stationary relative to the dipper, providing a stop for the third liner segment and preventing movement of the third liner segment in a first horizontal direction relative to the dipper.

4. The mining shovel of claim 1, wherein the removable liner assembly further comprises:

a third rail coupled to the dipper;

wherein the first liner segment is coupled to the third rail; and wherein at least a portion of the third rail is covered by the first liner segment.

5. The mining shovel of claim 4, wherein the third rail is substantially stationary relative to the dipper, providing support for the first liner segment and preventing movement of the first liner segment in a first horizontal direction relative to the dipper.

6. The mining shovel of claim 1, further comprising a locking mechanism for locking the removable liner assembly to the dipper.

7. The mining shovel of claim 1, wherein the removable liner assembly is sized and shaped to fit over the inner surface of the dipper such that the inner surface of the dipper is substantially covered.

8. The mining shovel of claim 1, wherein the first and second liner segments are releasably coupled to each other in an interlocking manner such that the first and second liner segments are substantially stationary relative to the dipper.

9. The mining shovel of claim 8, wherein the first and second liner segments may be removed from the dipper without the use of a heating or cutting device.

10. The mining shovel of claim 1, wherein the first rail comprises a generally U-shaped groove configured to mate with at least one of the first and second liner segments.

11. A removable liner assembly for a dipper, the removable liner assembly comprising:

a first rail configured to be coupled to the dipper;

a first liner segment positionable on the first rail and configured to cover a portion of the first rail;

a second liner segment removably couplable to the first rail and configured to cover at least one of a portion of the first liner segment and a portion of the first rail;

a second rail configured to be coupled to the dipper;

a third liner segment removably couplable to the second rail and configured to cover at least one of a portion of the second liner segment and a portion of the second rail; and a third rail configured to be coupled to the dipper;

wherein the first rail is substantially covered by at least one of the first and second liner segments; wherein the second liner is positionable on the second rail and configured to cover at least a portion of the second rail; wherein the second rail is substantially covered by at least one of the second and third liner segments; wherein the first liner segment is removably couplable to the third rail; and wherein at least a portion of the third rail is covered by the first liner segment.

12. The assembly of claim 11, wherein the first rail comprises a generally U-shaped groove configured to mate with at least one of the first and second liner segments.

13. A dipper for a mining shovel, the dipper comprising:

an inner surface;

a removable liner assembly adjacent to the inner surface, the removable liner assembly comprising:

a first rail coupled to the inner surface;

a first liner segment disposed on the first rail and covering at least a portion of the first rail;

a second liner segment removably coupled to the first rail and covering at least one of a portion of the first liner segment and a portion of the first rail;

a second rail coupled to the inner surface; and a third liner segment removable coupled to the second rail, the third liner segment covering at least one of a portion of the second liner segment and a portion of the second rail;

wherein the first rail is substantially covered by at least one of the first and second liner segments; wherein the second liner segment is disposed on the second rail and covering at least a portion of the second rail; and wherein the second rail is substantially covered by at least one of the second and third liner segments.

14. The dipper of claim 13, wherein the removable liner assembly further comprises:

a third rail coupled to the inner surface;

wherein the first liner segment is coupled to the third rail; and wherein at least a portion of the third rail is covered by the first liner segment.

15. The dipper of claim 13, wherein the removable liner assembly is sized and shaped to fit over the inner surface of the dipper such that the inner surface of the dipper is substantially covered.

16. The dipper of claim 13, wherein the first and second liner segments may be removed from the dipper without the use of a heating or cutting device.

* * * * *